United States Patent [19]

Bedell et al.

[11] 4,077,462

[45] Mar. 7, 1978

[54] CHILL ROLL CASTING OF CONTINUOUS FILAMENT

[75] Inventors: John R. Bedell, Sparta; Noel Y. Rothmayer, Madison; Ralph R. Saunders, Lafayette; Robert W. Smith, Flanders, all of N.J.

[73] Assignee: Allied Chemical Corporation, Morristown, N.J.

[21] Appl. No.: 701,338

[22] Filed: Jun. 30, 1976

[51] Int. Cl.[2] ..... B22D 11/06

[52] U.S. Cl. ..... 164/429

[58] Field of Search ..... 164/87, 276, 259

[56] References Cited

U.S. PATENT DOCUMENTS

| | | | |
|---|---|---|---|
| 2,099,208 | 11/1937 | Horsfall et al. | 164/259 |
| 2,348,178 | 5/1944 | Merle | 164/276 X |
| 3,862,658 | 1/1975 | Bedell | 164/87 |

*Primary Examiner*—Robert D. Baldwin

*Attorney, Agent, or Firm*—Gerhard H. Fuchs; David W. Collins

[57] ABSTRACT

Improvement in apparatus for making metal filament by depositing molten metal onto the peripheral surface of a rotating annular chill roll includes provision of a stationary housing surrounding the peripheral surface of the chill roll in an arc, covering the segment beginning at the vicinity of the point of deposition of the metal onto the chill roll and terminating at a predetermined point of stripping of the solid filament from the chill roll, and defining a gap between the peripheral surface of the chill roll and the interior of the housing, together with means for introducing a fluid into the gap for passage therethrough in the direction of rotation of the chill roll. In operation, cocurrent passage of the filament and the fluid through the gap effects controlled retention of the filament on the chill roll and fixes the point at which the filament is stripped from the chill roll.

5 Claims, 5 Drawing Figures

CHILL ROLL CASTING OF CONTINUOUS FILAMENT

BACKGROUND OF THE INVENTION

This invention relates to an improvement in apparatus for making continuous metal filaments, particularly amorphous metal filaments, by depositing molten metal onto the peripheral surface of a rotating annular chill roll to form a solid filament thereon. By means of this improvement, contact between the peripheral surface of the chill roll and the solidified filament is prolonged, the point of stripping of the solid filament from the chill roll is controlled, and conveyance of the stripped filament to a suitable collection point such as an automatic winding mechanism is aided.

For purposes of the present invention, a filament is a slender body whose transverse dimensions are much less than its length. In that context, filaments may be bodies such as ribbons, sheets or wires, of regular or irregular cross-section.

It is already known to make metal filaments by directing a jet of molten metal against a moving quenching surface whereon it is solidified. One of these known methods involves chill roll casting wherein a free jet of molten metal is impinged upon the peripheral surface of a rotating drum whereon it is solidified to form a filament which is then flung away from the drum by centrifugal action. Chill roll casting techniques employing the peripheral surface of a rotating drum or cylinder have, for example, been described by Strange and Pim in U.S. Pat. No. 905,758. The procedure described by Strange et al. may be readily employed to form filaments of many of the polycrystalline metals which possess sharp melting points, that is to say which have solid-liquid transition range of less than about 5° C. However, amorphous or glassy metals often have a transition range in the order of about 400° C. or more through which the viscosity of the metal gradually increases until the critical glass transition temperature is reached and it is necessary for the filament to be quenched below its glass transition temperature before departure from the quench roll. This is difficult to achieve by the procedure of Strange et al. because centrifugal force tends prematurely to fling the filament away from the drum surface. Also, by the procedure of Strange et al., the point at which stripping of the filament from the surface of the drum occurs varies, so that it is difficult to collect the filament and to guide it to a suitable winder.

Shortcomings concerning retention time of filament on the surface of the drum, and difficulties in collecting the filament from a variable point of stripping are overcome by the procedure described by Kavesh in U.S. Pat. No. 3,856,074, involving recovery of filaments formed on the exterior surface of a rotating drum by using nipping means.

It is an object of the present invention to provide a further apparatus for obtaining controlled retention of metal filament formed on the peripheral surface of a rotating chill roll.

It is another object of the present invention to provide apparatus for controlled retention of filament formed on the peripheral surface of a rotating chill roll which also permits stripping of the filament at a predetermined point, and which provides means for conveying the stripped filament to a suitable collection place, such as an automatic winder.

SUMMARY OF THE INVENTION

In accordance with the present invention there is provided in an apparatus for making metal filament including an annular chill roll rotatably mounted around its axis and means for depositing molten metal onto the peripheral surface of the chill roll as it is being rotated, the improvement which comprises: (a) a stationary housing surrounding at least a portion of the peripheral surface of the chill roll in an arc beginning at the vicinity of the point of deposition of the molten metal onto the chill roll and terminating at a predetermined point of stripping of the solid filament from the chill roll, and defining a gap between the peripheral surface of the chill roll and the interior of the housing, and (b) means for introducing a fluid into the gap for passage through the gap in the direction of rotation of the chill roll.

The present invention further provides an improvement in the process for making metal filament by depositing molten metal onto the peripheral surface of a rotating chill roll and stripping the solid filament from the chill roll, which improvement comprises guiding a stream of fluid around the perimeter of the rotating chill roll in contact with a metal filament deposited thereon, in an arc beginning at the vicinity of the point of deposition of the molten metal onto the chill roll and terminating at a predetermined point of stripping of the solid filament from the chill roll, the stream having a velocity at least equal to the velocity of the perimeter of the chill roll.

The method and apparatus of the present invention advantageously permit prolonged contact of the metal filament deposited on the peripheral surface of the rotating chill roll, thereby enhancing cooling of the molten metal to and below the critical glass transition temperature, as is necessary for the production of amorphous metal filaments. The method and apparatus of the present invention are eminently suited for making filaments of polycrystalline metals, of alloys forming amorphous metals, and of nonductile or brittle alloys which are not readily formable into filaments using conventional processes.

BRIEF DESCRIPTION OF THE DRAWINGS

The annexed drawings, wherein like reference numerals denote like parts, further illustrate the present invention.

FIG. 3 further shows an extension of the housing for conveying the stripped filament away from the chill roll to a collecting device (not shown).

DETAILED DESCRIPTION OF THE INVENTION AND OF THE PREFERRED EMBODIMENTS

Figure 1:
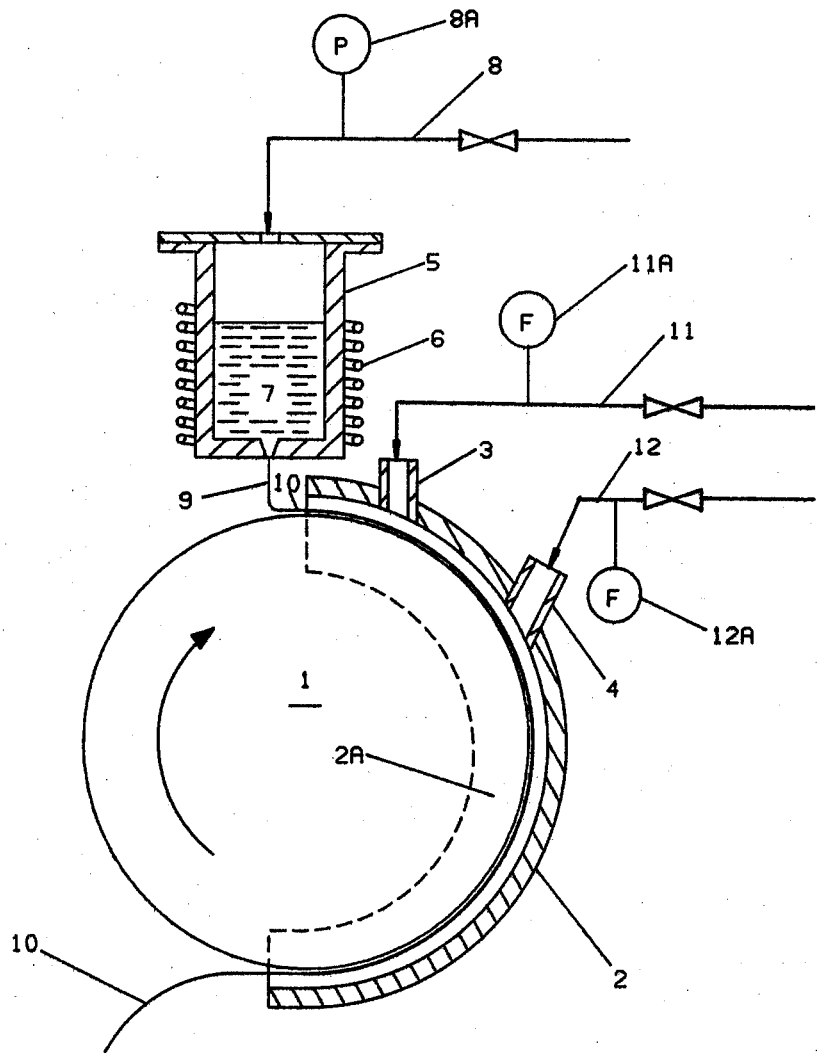
FIG. 1 is a side view in partial cross-section showing arrangement of the stationary housing surrounding the peripheral surface of the chill roll and fluid inlet jets for introducing fluid into the gap defined by the housing for passage therethrough in the direction of rotation of the chill roll.

With reference to FIG. 1 of the drawings, apparatus employed comprises a chill roll 1 rotatably mounted around its longitudinal axis, housing 2 surrounding the peripheral surface of chill roll 1 in an arc beginning at the vicinity of the point of deposition of molten metal onto the chill roll and terminating at a predetermined point of stripping of the solid filament from the chill roll, having side walls 2*a* partially enclosing the sides of the chill roll. Housing 2 is equipped with fluid inlet ports 3 and 4. Crucible 5 having an aperture in the bottom thereof for squirting molten metal therefrom is equipped with heating element 6 and contains pool of molten metal 7. In operation, pool of molten metal 7 in crucible 5 is pressurized, as by padding it with inert gas introduced through gas supply line 8. Pressure gauge 8*a* is conveniently provided to permit control of pressure in crucible 5. Pressurization of the molten metal in crucible 5 results in squirting of a jet of molten metal 9 for impingement on the peripheral surface of chill roll 1 to form filament 10 thereon. Fluid is supplied by means of lines 11 and 12, is introduced through fluid inlet ports 3 and 4 into the gap formed between the housing and the peripheral surface of the chill roll 1, and passes through the gap in the direction of rotation of the chill roll. The stream of fluid in the gap has a velocity at least equal to the velocity of the perimeter of the chill roll. Fluid flow can be controlled by means of optional flow meters 11*a* and 12*a*. Housing 2 serves to guide the stream of fluid introduced through fluid inlet ports 3 and 4 around the perimeter of the rotating chill roll in contact with the metal filament deposited thereon, thereby retaining the metal filament in contact with or at least in the vicinity of the peripheral surface of the chill roll. Filament 10 is stripped from the peripheral surface of the chill roll and flung away from the chill roll at a precisely controlled predetermined point defined by the termination of housing 2 distal from the point of impingement of jet of molten metal 9 on the exterior surface of the chill roll.

Figure 2:
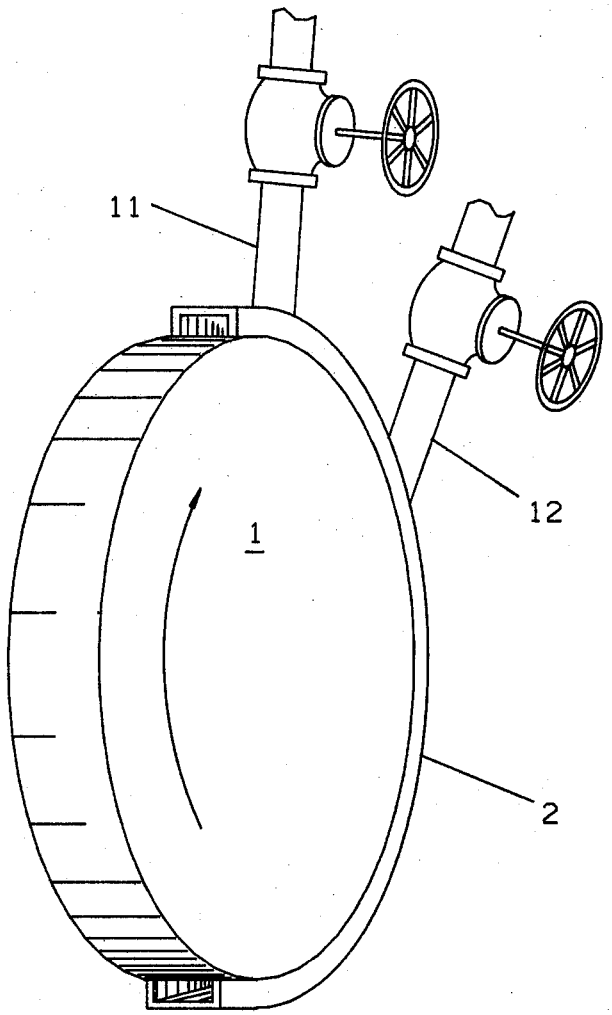
FIG. 2 provides an isometric view of a chill roll surrounded by one embodiment of a housing in accordance with the present invention (associated equipment not shown).

FIG. 2 provides an isometric view of a chill roll 1 partially surrounded by another embodiment of a housing in accordance with the present invention shown with fluid supply lines 11 and 12 terminating in inlet ports 3 and 4, respectively (covered by the housing).

Figure 2A:
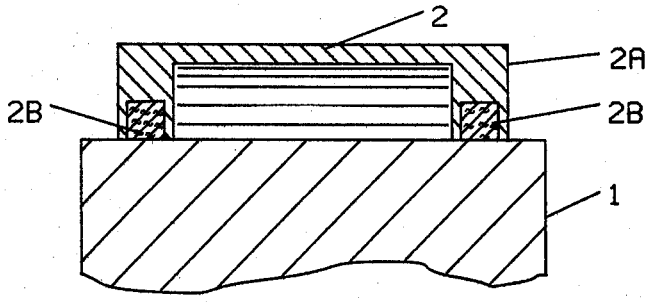
FIG. 2*a* is a partial fractional view in cross-section illustrating one means for effecting seal between the peripheral surface of the chill roll and a housing of the type illustrated by FIG. 2.

FIG. 2*a* illustrates one means for effecting seal between the chill roll and the type of housing illustrated by FIG. 2. Sidewalls 2*a* of housing 2 here are not extended over the sides of the peripheral surface of chill roll 1, as illustrated in FIG. 1, but they terminate a short distance away from the peripheral surface of the chill roll. Recesses are cut into sidewalls 2*a* for insertion of seals 2*b* carried in sliding contact with the peripheral surface of chill roll 1 to effect fluid seal between housing and chill roll surface. Seals 2*b* may be constructed of any suitable material, e.g. felt. Other means for sealing may be provided, for example, labyrinth seals.

Figure 3:
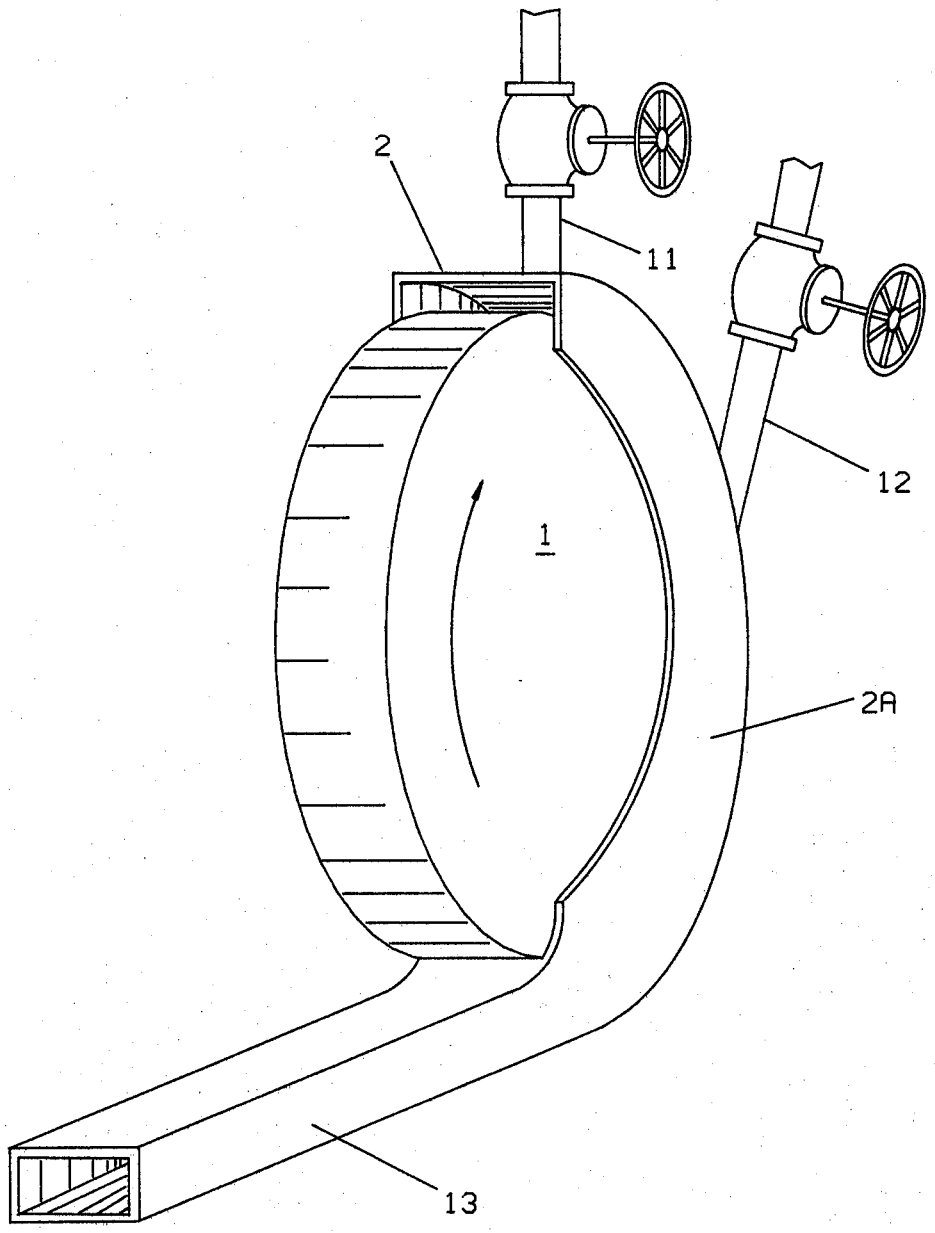
FIG. 3 provides an isometric view of a chill roll surrounded by another embodiment of a housing.

FIG. 3 illustrates a housing of the type illustrated by FIG. 1 terminating in a filament conveying tube 13, which collects the filament at the point of stripping from the chill roll for conveying to a suitable collection device (not shown).

Figure 4:
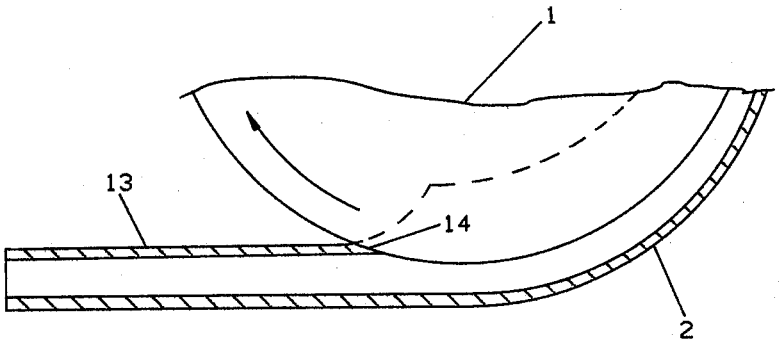
FIG. 4 is a fractional side view in partial cross-section showing the lower portion of a chill roll surrounded by a housing of the type illustrated by FIG. 3, terminating in an extension for guiding the stripped filament away from the chill roll.

FIG. 4 illustrates optional means for stripping the filament from the peripheral surface of the chill roll comprising a lip 14 forming part of conveying tube 13, said lip maintained in sliding contact with the peripheral surface of chill roll 1.

The molten metal which is to be formed into a filament may be deposited onto the peripheral surface of the chill roll by any suitable means. For purposes of the present invention, the means by which this is accomplished are not critical. One suitable method is illustrated in the drawing and involves heating the metal, preferably in an inert atmosphere or under subatmospheric pressure, to temperature approximately 50° to 100° C. above its melting point or higher, and then ejecting the molten metal through a nozzle for deposition onto the chill roll, as by pressuring the metal with an inert gas to pressure in the order of, say, 1 to 50 p.s.i.g. or until a stream of molten metal is ejected through the nozzle.

The peripheral surface of the chill roll which provides the actual quench surface can be any material having sufficient structural strength and thermal resistance, and having relatively high thermal conductivity. This latter requirement is particularly applicable if it is desired to make amorphous or meta-stable filaments. Preferred materials of construction include beryllium copper, oxygen-free copper, and stainless steel to provide protection against corrosion, erosion, or thermal fatigue. The peripheral surface of the chill roll may be coated with a suitable resistant or high melting coating, for example a ceramic coating or a coating of corrosion resistant metal, which coating may be applied by known procedures.

The stationary housing surrounding the peripheral surface of the chill roll in an arc begins at the velocity of the point of deposition of the molten metal onto the chill roll sufficiently close thereto so that at the beginning of the housing the metal filament still closely adheres to the peripheral surface of the chill roll and is not yet flung away therefrom. The housing may terminate at a location represented by an angle of rotation of the chill roll from the point of deposition of the molten metal onto the peripheral surface of the chill roll of less than 360°, generally less than about 320°, desirably less than about 270°, preferably in the order of about 30° to 180°. Desirably, the housing surrounds the peripheral surface of the chill roll at substantially equal distance therefrom throughout to define a gap of substantially constant dimensions throughout the length of the housing. Desirably, the gap is of from about 25 to about 200, preferably of from about 50 to about 100 times the thickness of the filament. A seal should be provided to prevent excessive escape of fluid from the gap along the length of the housing. This may conveniently be accomplished as illustrated in FIGS. 1 and 3, wherein skirt 2*a* of the housing is carried in close proximity to the side surfaces of the chill roll to provide a narrow gap therebetween to minimize escape of fluid therethrough. Alternatively, a sliding seal may be provided, as illustrated in FIGS. 2 and 2*a*.

The housing may be provided with one or more fluid inlet ports along its length, at least one of which is located at that end of the housing near the point of deposition of the metal onto the chill roll, at least one of the inlet ports being angled in the direction of rotation of th chill roll to insure fluid flow in the direction of the rotation of the chill roll. There is no limit to the number of inlet ports that may be provided, other than that dictated by practical considerations of apparatus design.

The fluid to be introduced through the inlet port or ports may be any liquid or gas which is substantially inert with respect to the apparatus and the filament. Gaseous fluids are preferred for the sake of convenience. Suitable gaseous fluids include inert gas such as nitrogen, helium or argon, also air or steam. Air is a preferred fluid for reason of ready availability.

Fluid is introduced through the inlet port or ports at a rate sufficient to insure that the stream of fluid flowing along the gap with the rotation of the chill roll has a velocity at least equal to the velocity of the perimeter of the chill roll. Desirably, the velocity of the fluid is from about 1.1 to about 3 times the velocity of the perimeter of the chill roll, preferably of from about 1.4 to 2 times the velocity of the perimeter of the chill roll. If the velocity of the fluid stream is less than the rotational velocity of the perimeter of the chill roll, then the filament may disengage from the exterior surface of the chill roll due to action of centrifugal force, the fluid acting as an undesirable drag on the movement of the filament, causing the filament to bunch up, and the gap formed between the chill roll and the housing will be plugged in short order by the loose filament. Rather, it is desired that the faster moving fluid forces the filament into a shortened path around the chill roll, thereby forcing the filament into contact with the peripheral surface of the chill roll. To insure sufficient flow velocity, it may be desirable to install flow measuring devices in the line feeding the fluid to the inlet ports to permit control of the amount of fluid being introduced, as is illustrated in FIG. 1. It is also possible to cool the fluid prior to introduction into the apparatus, thereby providing cooling for the chill roll.

In an especially preferred embodiment, the housing terminates in a filament conveying tube as illustrated by FIG. 3, which serves to guide the stripped filament away from the chill roll and towards a suitable collecting means, such as an automatic winder. The filament conveying tube is in communication with the gap formed between the housing and the peripheral surface of the chill roll, so that fluid introduced into the gap will continue to flow through the filament conveying tube, thereby conveying the stripped filament. The filament conveying tube may be a straight tube, or it may be gently turned in any desired direction so long as care is taken to avoid abrupt turns which may lead to friction between the filament and the interior walls of the tube, resulting in eventual plugging of the tube by the filament. Optionally, the filament conveying tube may be provided with a lip which is carried in sliding contact with the peripheral surface of the chill roll, as illustrated in FIG. 4, to aid in stripping the filament from the chill roll.

Detailed design and construction of apparatus of the present invention is within the capability of any competent worker skilled in the art.

The following Example further illustrates the present invention and sets forth the best mode presently contemplated for its practice.

EXAMPLE

Apparatus employed is similar to that depicted in FIG. 1. The chill roll employed has an outer diameter of 14 inches, and it is 3 inches wide. It is rotated at a speed of about 1400 rpm. The stationary housing begins at an angle of 10° from the point of deposition of the molten metal onto the peripheral surface of the chill roll, and terminates at an angle of 170°, measured from the point of its beginning in the direction of rotation of the chill roll. The gap between the exterior surface of the chill roll and the interior surface of the housing measures $\frac{3}{8}$ inches throughout. Air as fluid is introduced into the gap by means of air inlet ports located 50° and 80°, measured from the beginning of the housing in direction of rotation of the chill roll. Air is introduced at ambient temperature at a rate of 20 scfm to the first and 20 scfm to the second fluid inlet port. The velocity of fluid flow in the gap is calculated to be about twice the velocity of the chill roll at its perimeter. The housing terminates in a filament conveying tube similar to that illustrated by FIG. 3. A jet of molten metal of 0.052 inch diameter is impinged on the peripheral surface of the chill roll at a point 10° from the point of beginning of the housing measured opposite to the direction of rotation of th chill roll. The metal solidifies on the surface of the chill roll into a ribbon of about 0.002 inch thickness and width of 0.07 inch, which is continuously discharged at the outlet of the filament conveying tube.

Since various changes and modifications may be made in the invention without departing from the spirit and essential characteristics thereof, it is intended that all matter contained in the above description shall be interpreted as illustrative only, the invention being limited only by the scope of the appended claims.

We claim:

1. In an apparatus for making metal filament including an annular chill roll rotably mounted around its axis and means for depositing molten metal onto the peripheral surface of the chill roll as it is being rotated, the improvement which comprises: a stationary housing surrounding the peripheral surface of the chill roll in an arc beginning at the vicinity of the point of deposition of the molten metal onto the chill roll and terminating at a predetermined point of stripping of the solid filament from the chill roll, and defining a gap between the peripheral surface of the chill roll and the interior of the housing, said housing including means providing a seal along the length of the housing between it and the chill roll to prevent excessive escape of fluid from the gap, and terminating in an outlet at the predetermined point of stripping of the solid filament from the chill roll for cocurrent discharge of the filament and the fluid; and means for introducing a fluid into the gap defined by the housing for passage through the gap in the direction of rotation of the chill roll, including at least one inlet port being angled in the direction of rotation of the chill roll to insure fluid flow in the direction of movement of the chill roll.

2. The improvement of claim 1 wherein the stationary housing terminates in a filament conveying tube in communication with the gap formed between the housing and the peripheral surface of the chill roll.

3. The improvement of claim 2 wherein the filament conveying tube is provided with a lip, said lip being maintained in sliding contact with the peripheral surface of the chill roll.

4. The improvement of claim 1 wherein the gap formed between the housing and the peripheral surface is of substantially constant dimensions throughout its length.

5. The improvement of claim 1 wherein the means providing a seal comprises a pair of skirts formed of the side walls of the housing being positioned in close proximity to the side surfaces of the chill roll to provide a narrow gap therebetween to minimize escape of fluid therethrough.

* * * * *